US012037884B2

(12) United States Patent
Greska

(10) Patent No.: US 12,037,884 B2
(45) Date of Patent: Jul. 16, 2024

(54) REMOTE HYDRAULIC VALVE CONTROL SYSTEM

(71) Applicant: CACTUS WELLHEAD, LLC, Houston, TX (US)

(72) Inventor: Brenton Greska, Katy, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 388 days.

(21) Appl. No.: 17/569,118

(22) Filed: Jan. 5, 2022

(65) Prior Publication Data

US 2022/0220837 A1 Jul. 14, 2022

Related U.S. Application Data

(60) Provisional application No. 63/135,368, filed on Jan. 8, 2021.

(51) Int. Cl.
*E21B 43/26* (2006.01)

(52) U.S. Cl.
CPC ..... *E21B 43/2607* (2020.05)

(58) Field of Classification Search
CPC ..... E21B 43/2607; E21B 43/12
See application file for complete search history.

(56) References Cited

U.S. PATENT DOCUMENTS

2004/0244993 A1* 12/2004 Crawford ..... E21B 17/203 166/77.2
2017/0139392 A1* 5/2017 Abou-Assaad ..... E21B 19/09
2017/0146189 A1* 5/2017 Herman ..... F16N 13/22

* cited by examiner

*Primary Examiner* — Giovanna Wright
(74) *Attorney, Agent, or Firm* — Ewing & Jones, PLLC

(57) ABSTRACT

A remote hydraulic system for controlling a valve of a wellhead or frac manifold includes a remote hydraulic skid, control skid, and power supply skid. The remote hydraulic skid includes a hydraulic reservoir, a hydraulic pump, an accumulator, a hydraulic manifold operatively coupled to the accumulator, and a hydraulic valve operatively coupled to the hydraulic manifold. The hydraulic valve is operatively coupled to the valve of the wellhead or frac manifold by a hydraulic line. The control skid includes an interface and is operatively coupled to the remote hydraulic skid by a control line. The control skid is adapted to control the actuation of the hydraulic valve. The power supply skid is coupled to the remote hydraulic skid to provide the power necessary to drive the hydraulic pump on the remote hydraulic skid. The remote hydraulic skid is positioned within a hazardous zone around the wellhead, while the control skid and power supply skid are positioned outside of the hazardous zone.

18 Claims, 10 Drawing Sheets

REMOTE HYDRAULIC VALVE CONTROL SYSTEM

CROSS-REFERENCE TO RELATED APPLICATIONS

This application is a nonprovisional application which claims priority from U.S. provisional application No. 63/135,368, filed Jan. 8, 2021, which is incorporated by reference herein in its entirety.

TECHNICAL FIELD/FIELD OF THE DISCLOSURE

The present disclosure relates generally to oilfield equipment and specifically to hydraulic systems for wellhead equipment.

BACKGROUND OF THE DISCLOSURE

During well completions or during workover, an assembly of valves, commonly referred to as a frac tree, is coupled to the wellhead. The valves of the frac tree are used to allow fluid conduits passing into and out of the well to be selectively opened or closed. Additional valves may be positioned on manifolds to transmit frac fluid to the frac tree. During certain operations, such as hydraulic fracturing, the frac tree may contain large pressures within the well. In some cases, valves of the frac tree may be opened and closed hydraulically. However, due to the hazards involved with wellbore operations including, for example, high pressures and potentially flammable atmospheres, the area around the frac tree may be too dangerous for wellsite personnel to remain in the vicinity to manually operate the valves of the frac tree.

SUMMARY

The present disclosure provides for a remote hydraulic system for controlling a valve of a wellhead or frac manifold. The remote hydraulic system may include a remote hydraulic skid. The remote hydraulic skid may include a hydraulic reservoir, a hydraulic pump, and an accumulator.

The remote hydraulic skid may include a hydraulic manifold operatively coupled to the accumulator. The remote hydraulic skid may include a hydraulic valve operatively coupled to the hydraulic manifold. The hydraulic valve may be operatively coupled to the valve of the wellhead or frac manifold by a hydraulic line. The remote hydraulic system may include a control skid. The control skid may include an interface. The control skid may be operatively coupled to the remote hydraulic skid by a control line. The control skid may be adapted to control the actuation of the hydraulic valve. The remote hydraulic system may include a power supply skid coupled to the remote hydraulic skid to provide the power necessary to drive the hydraulic pump on the remote hydraulic skid. The remote hydraulic skid may be positioned within a threshold distance of the wellhead defining a hazardous zone. The control skid and power supply skid may be positioned outside of the hazardous zone.

The present disclosure also provides for a method. The method may include providing a power supply skid and positioning the power supply skid outside of a threshold distance of a wellhead or a frac manifold defining a hazardous zone. The method may include providing a remote hydraulic skid. The remote hydraulic skid may include a hydraulic reservoir, a hydraulic pump, accumulator, and a hydraulic manifold. The remote hydraulic skid may include a hydraulic valve operatively coupled to the hydraulic manifold and having an output port. The method may include positioning the remote hydraulic skid within the hazardous zone. The method may include operatively coupling the hydraulic pump to the power supply skid by a supply umbilical and coupling the output port of the hydraulic valve to a port of a valve of the wellhead or the frac manifold by a hydraulic line. The method may include providing a control skid, the control skid including an interface. The method may include positioning the control skid outside of the hazardous zone and operatively coupling the control skid to the remote hydraulic skid by a control line. The control skid may be adapted to control the actuation of the hydraulic valve. The method may include providing power to the remote hydraulic skid with the power supply skid, actuating the hydraulic valve with the control skid, and providing hydraulic fluid to the valve of the wellhead or the frac manifold.

The present disclosure also provides for a remote hydraulic system for controlling a valve of a wellhead or frac manifold. The remote hydraulic system may include an accumulator skid, the accumulator skid including a hydraulic reservoir and a hydraulic pump. The remote hydraulic system may include a remote hydraulic skid. The remote hydraulic skid may include a hydraulic manifold, the hydraulic manifold operatively coupled to the hydraulic pump of the accumulator skid by a supply umbilical. The remote hydraulic skid may include a hydraulic valve, the hydraulic valve operatively coupled to the hydraulic manifold, the hydraulic valve operatively coupled to the valve of the wellhead or frac manifold by a hydraulic line. The remote hydraulic system may include a control skid, the control skid including an interface, the control skid operatively coupled to the remote hydraulic skid by a control line, the control skid adapted to control the actuation of the hydraulic valve. The remote hydraulic skid may be positioned within a threshold distance of the wellhead defining a hazardous zone. The accumulator skid and control skid may be positioned outside of the hazardous zone.

The present disclosure also provides for a method. The method may include providing an accumulator skid, the accumulator skid including a hydraulic reservoir and a hydraulic pump. The method may include providing a remote hydraulic skid. The remote hydraulic skid may include a hydraulic manifold and a hydraulic valve, the hydraulic valve operatively coupled to the hydraulic manifold, the hydraulic valve having an output port. The method may include positioning the remote hydraulic skid within a threshold distance of a wellhead or a frac manifold defining a hazardous zone. The method may include operatively coupling the hydraulic manifold to the hydraulic pump of the accumulator skid by a supply umbilical. The method may include coupling the output port of the hydraulic valve to a port of a valve of the wellhead or the frac manifold by a hydraulic line. The method may include providing a control skid, the control skid including an interface, positioning the control skid outside of the hazardous zone, and operatively coupling the control skid to the remote hydraulic skid by a control line, the control skid adapted to control the actuation of the hydraulic valve. The method may include providing hydraulic fluid to the remote hydraulic skid with the accumulator skid, actuating the hydraulic valve with the control skid, and providing hydraulic fluid to the valve of the wellhead or the frac manifold.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
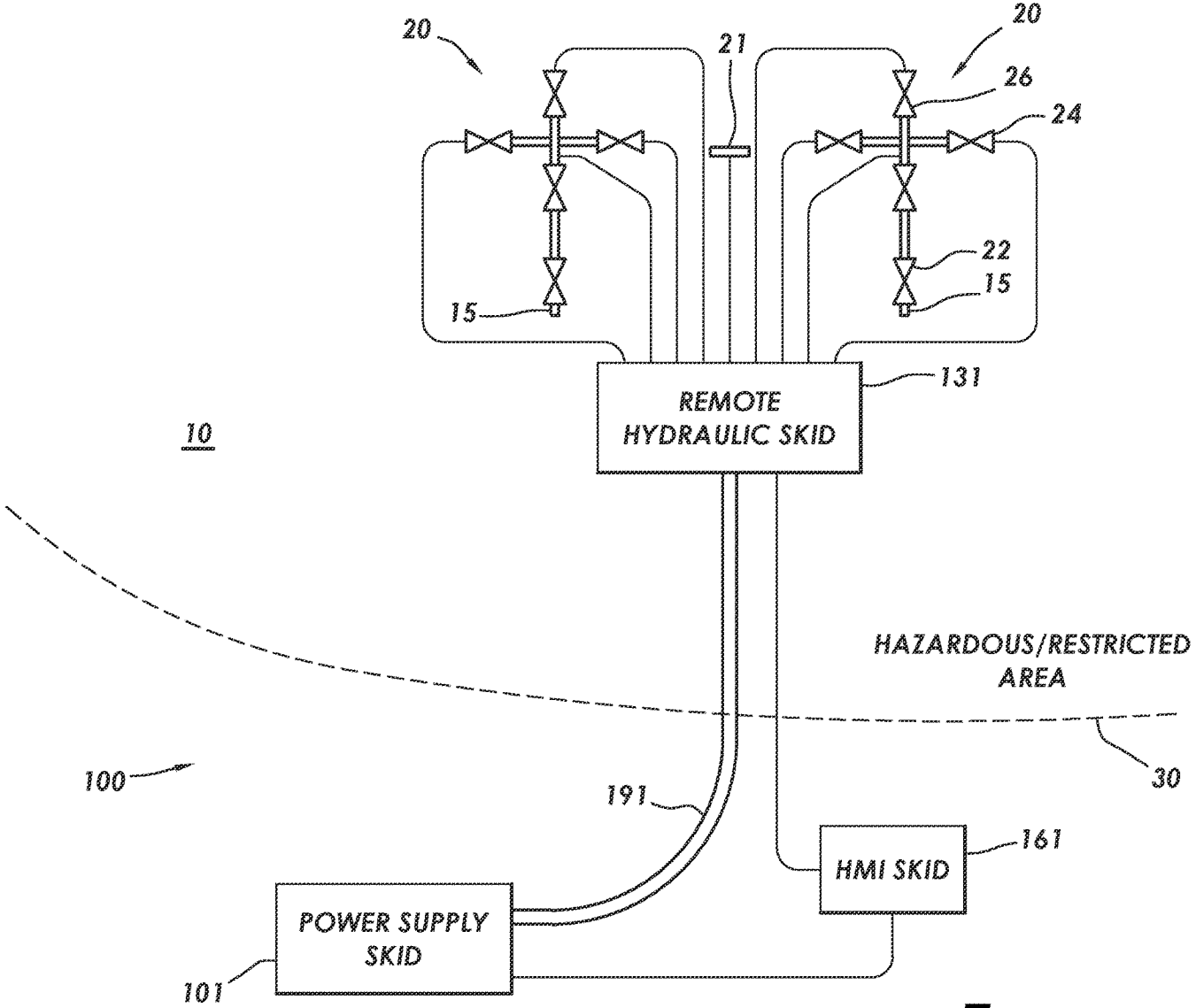
FIG. 1 depicts an overview of a wellsite including a remote hydraulic system consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1A:
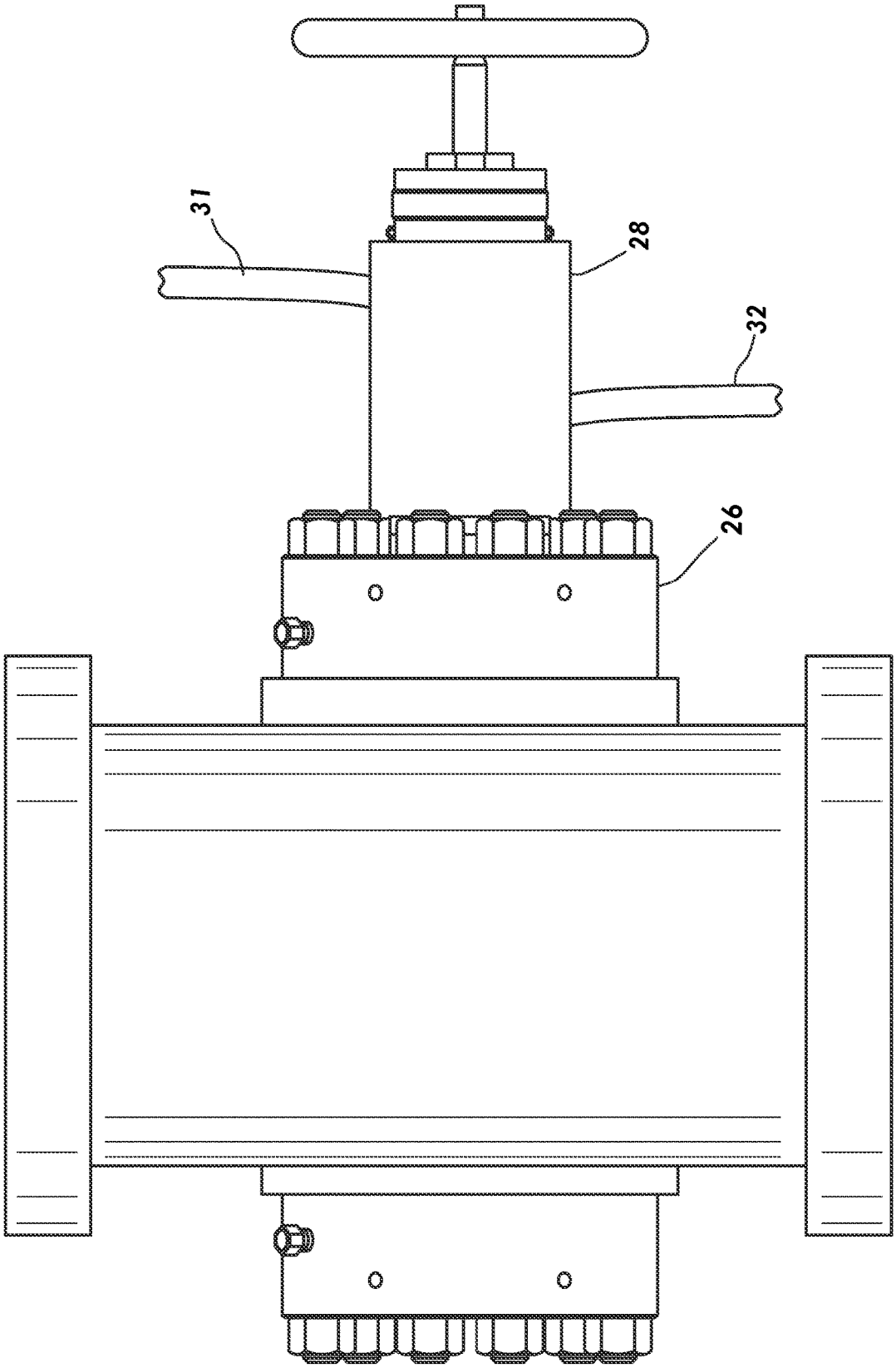
FIG. 1A depicts a detail view of a valve of a frac tree of the wellsite depicted in FIG. 1.

FIG. 1 depicts wellsite 10. Wellsite 10 may include one or more wells, depicted as wellheads 15. One or more of wellheads 15 may include a valve assembly coupled to wellhead 15, depicted as and referred to herein as frac trees 20. In some embodiments, wellsite 10 may also include one or more frac manifolds 21, which may be used to supply fluid to frac trees 20 during hydraulic fracturing operations. Each frac tree 20 may include one or more valves including, for example and without limitation, master valves 22, wing valves 24, and swab (or crown) valve 26. In some embodiments, one or more valves of frac tree 20 may be hydraulically operated such that opening and closing of the frac tree 20 valves may be controlled by remote hydraulic system 100. In some embodiments, any such valves, such as swab (or crown) valve 26 shown in FIG. 1A, may include hydraulic valve actuator 28. Hydraulic valve actuator 28 may be adapted to control the opening and closing of swab (or crown) valve 26 as hydraulic fluid is introduced into opening port 31 or closing port 32 as further described below.

Remote hydraulic system 100 may be positioned at wellsite 10. In some embodiments, such as shown in FIGS. 1-4, remote hydraulic system 100 may include power supply skid 101, remote hydraulic skid 131, and control skid 161. In some embodiments, as shown in FIG. 1, remote hydraulic skid 131 may be positioned near frac tree 20. In some embodiments, power supply skid 101 and control skid 161 may be positioned a distance away from remote hydraulic skid 131 to, for example and without limitation, allow an operator of control skid 161 to remain a safe distance away from frac tree 20 while a wellbore operation is underway. Thus, the operator may be able to operate remote hydraulic system 100 and thereby control the operations of valves of frac tree 20 during such a wellbore operation. For example and without limitation, in some embodiments, control skid 161 may be positioned outside of the defined hazardous zone 30. Hazardous zone 30 may be defined as an area within a threshold distance about frac tree 20, wherein the threshold distance may be defined based on anticipated conditions around frac tree 20. For example and without limitation, in some embodiments, hazardous zone 30 may be identified as a Class I or Class II location as defined by the NEC, wherein Class I locations are those in which flammable gases or vapors are or may be present in the air in quantities sufficient to produce explosive or ignitable mixtures, and Class II locations are those that are hazardous because of the presence of combustible dust. In some embodiments, the threshold distance may also take into account the presence of equipment containing high-pressure fluids including, for example and without limitation, frac tree 20 and frac manifold 21. In some cases, for example and without limitation, hazardous zone 30 may be defined as extending between 25 and 150 feet from frac tree 20 and frac manifold 21. In some cases, for example and without limitation, hazardous zone 30 may be defined as extending 50 feet from frac tree 20 and frac manifold 21.

Figure 2:
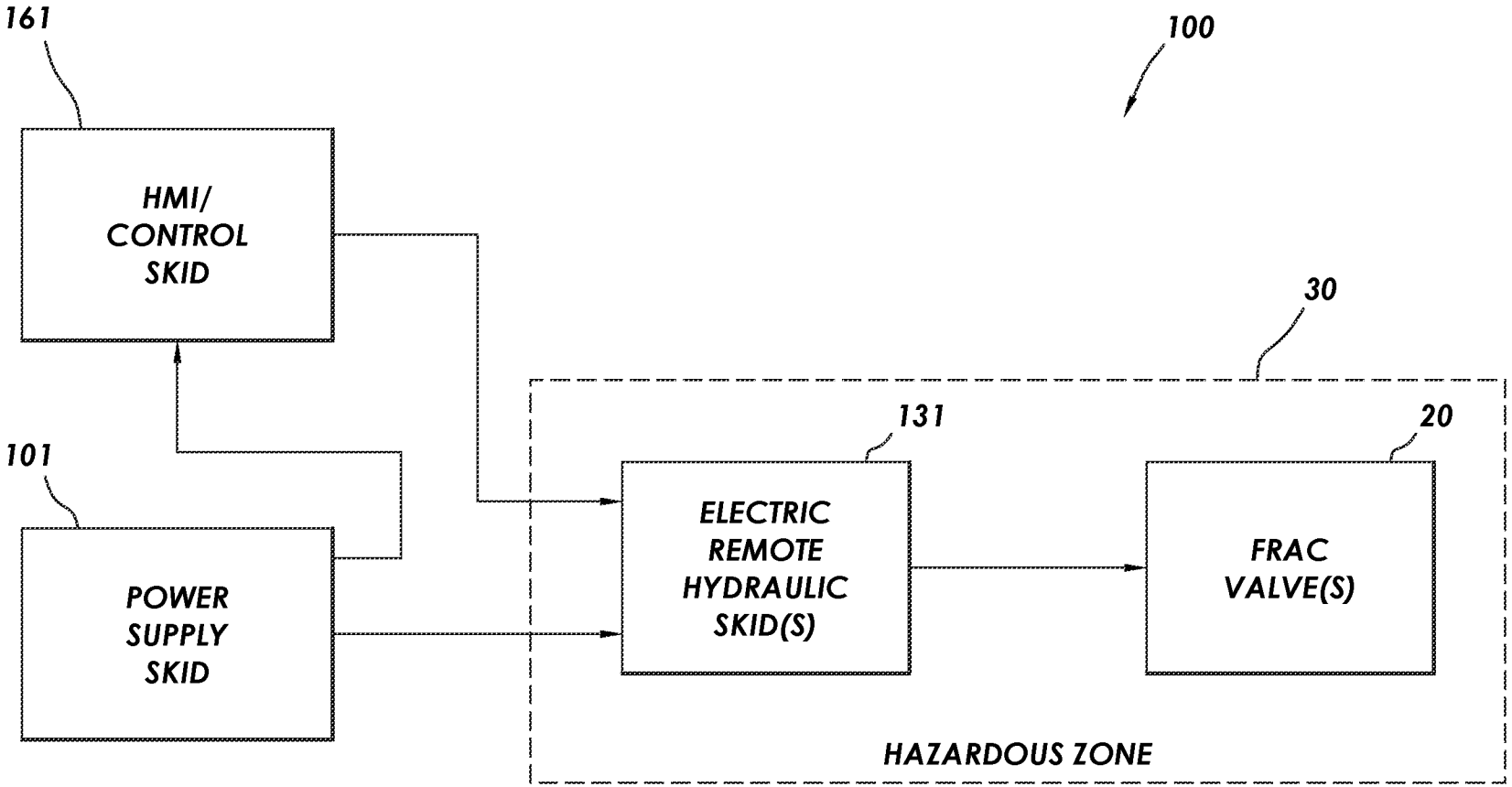
FIG. 2 depicts a schematic diagram of a remote hydraulic system consistent with at least one embodiment of the present disclosure.
Figure 3:
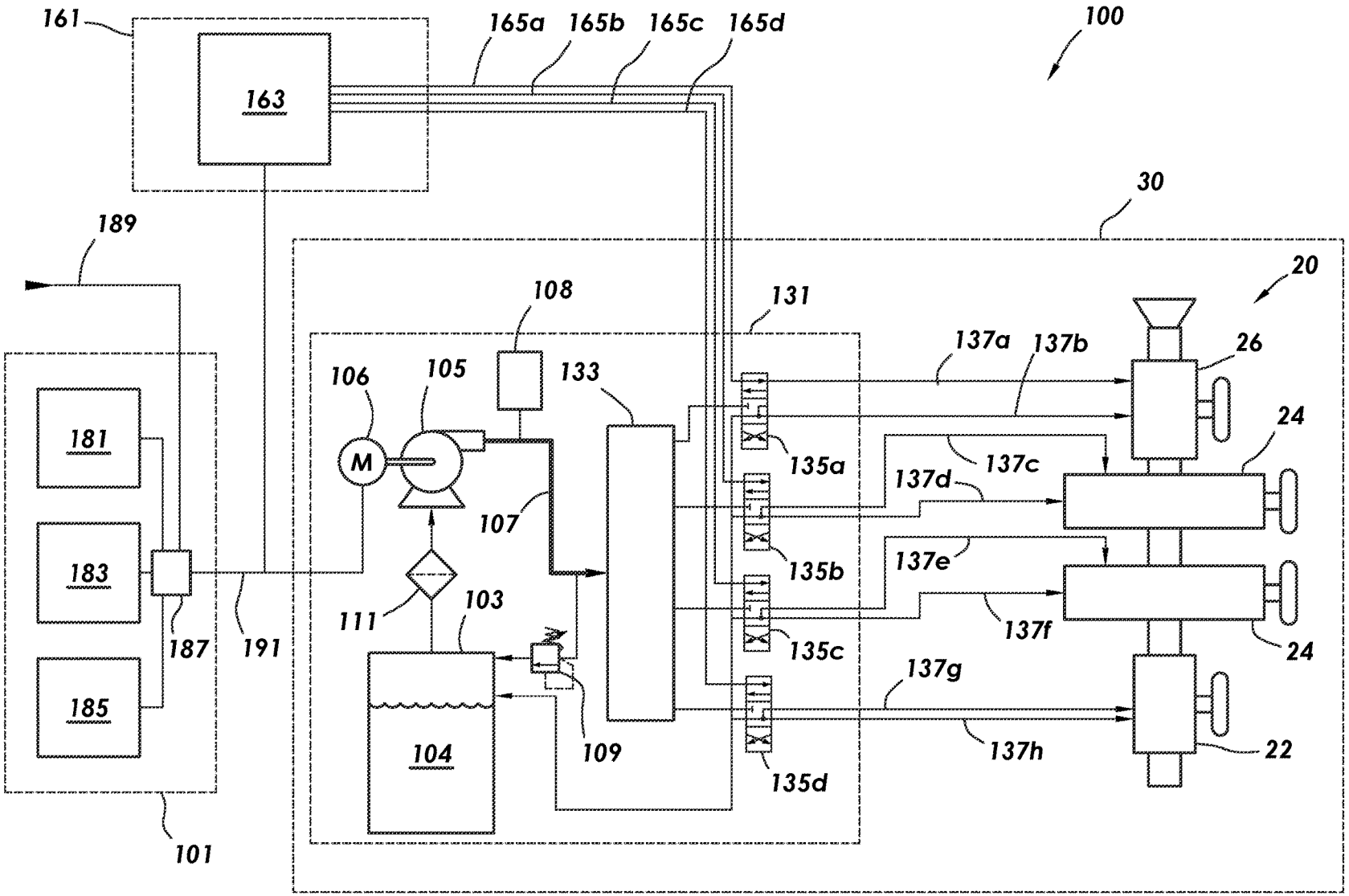
FIG. 3 depicts a process flow diagram of a remote hydraulic system consistent with at least one embodiment of the present disclosure.

In some embodiments, as depicted in FIGS. 2 and 3, power supply skid 101, remote hydraulic skid 131 and control skid 161 may be operatively coupled to allow control of valves of frac tree 20 and frac manifold 21. Although a single power supply skid 101 and a single remote hydraulic skid 131 are depicted, any number of power supply skids 101 and remote hydraulic skids 131 may be used and controlled by a single control skid 161 without deviating from the scope of the present disclosure.

In some embodiments, power supply skid 101 may include one or more systems for generating, storing, and supplying electric power to remote hydraulic skid 131, control skid 161, and any other pieces of wellsite equipment desired. For example and without limitation, in some embodiments, power supply skid 101 may include one or power supplies including, for example and without limitation, generator 181 and solar panels 183. Generator 181 may, in some embodiments, be driven by a diesel motor. Because generator 181 is positioned outside of hazardous zone 30, the possible negative effects of operating a heat-generating device and possible fire or explosion hazard proximate frac tree 20 is reduced. Thus, generator 181 may be operated without regard for the status of frac tree 20 including, for example and without limitation, continuously. Similarly, solar panels 183 may operate to passively generate electricity.

In some embodiments, power supply skid 101 may include energy storage device 185. Energy storage device 185 may be any device suitable for storing electrical power, such as may be generated by generator 181 and solar panels 183. Energy storage device 185 may be, for example and without limitation, one or more of batteries, kinetic energy storage devices, or capacitor banks. In some embodiments, power supply skid 101 may include controller 187. Controller 187 may, in some embodiments, control the operation of power supply skid 101 including controlling operation of generator 181, charging of energy storage device 185, conditioning power from solar panels 183, and supplying electric power to remote hydraulic skid 131 and control skid 161. In some embodiments, controller 187 may be positioned in control skid 161 or may be controlled at least in part by control skid 161. In some embodiments, power supply skid 101 may be connected to main power supply 189 to, for example and without limitation, use the utility grid for electric power to operate remote hydraulic system 100 or charge energy storage device 185.

In some embodiments, remote hydraulic skid 131 may include hydraulic fluid reservoir 103. Hydraulic fluid reservoir 103 may be a tank used to store hydraulic fluid 104 for use in remote hydraulic system 100. Remote hydraulic skid 131 may include one or more pumps 105 positioned to pump hydraulic fluid 104 from hydraulic fluid reservoir 103 to charge accumulator bottles 108. In some embodiments, pumps 105 may be, for example and without limitation, positive displacement pumps such as piston pump, screw pump, or progressing cavity pump. Pumps 105 may transfer hydraulic fluid into supply line 107.

In some embodiments, pumps 105 may be driven by electric motors 106. Electric motors 106 may be explosion-proof electric motors as understood in the art. By selecting explosionproof electric motors, operation of pumps 105 by electric motors 106 within hazardous zone 30 may be safer than the operation of other pump arrangements including, for example, diesel motors, due to the reduced likelihood of, for example and without limitation, ignition of flammable gases within hazardous zone 30. Electric motors 106 may be supplied with electric power from power supply skid 101 via umbilical 191. In other embodiments, pumps 105 may be pneumatically driven, in which case rather than electric power, pneumatic power is supplied from power supply skid 101.

Figure 4:
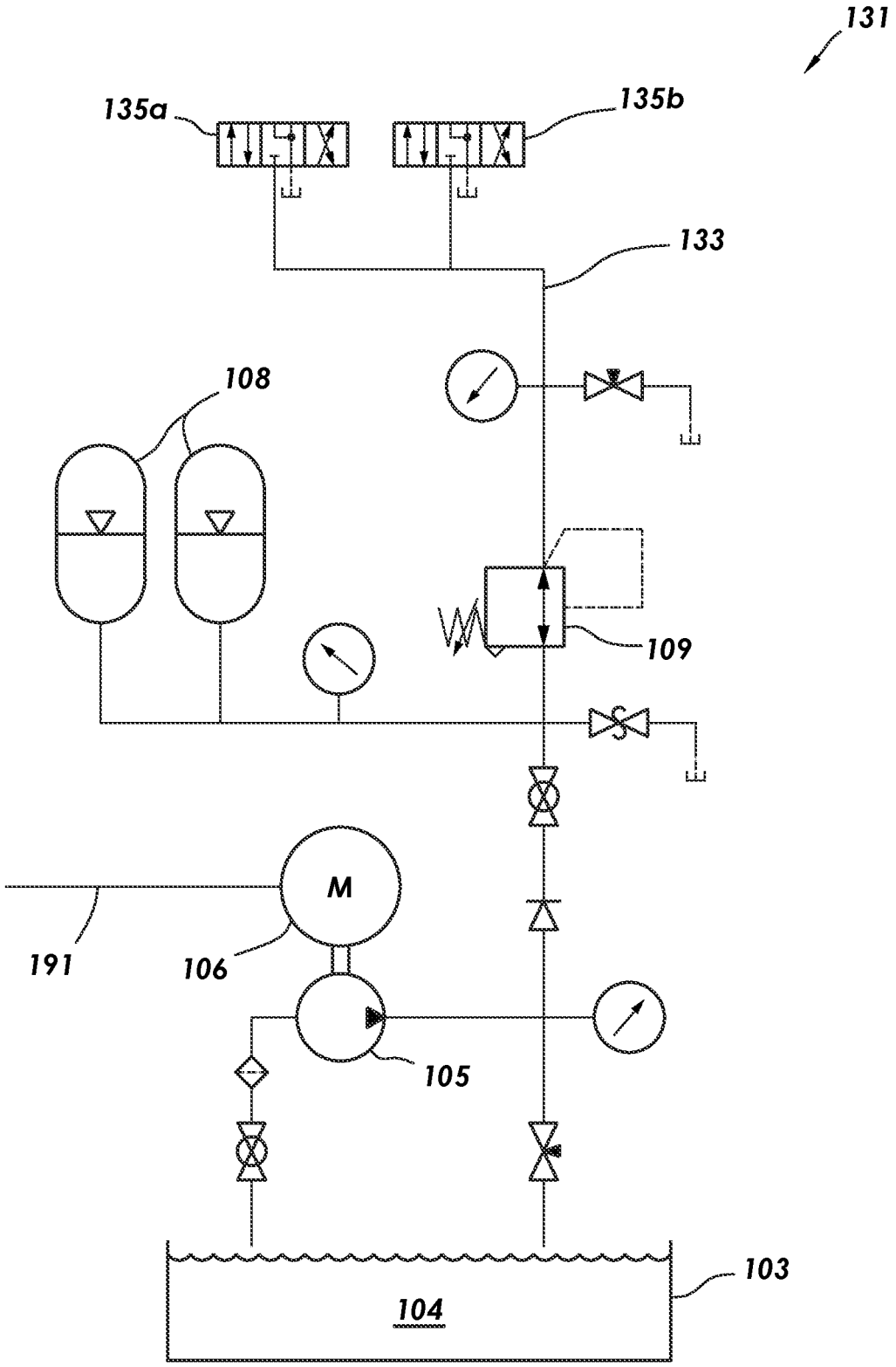
FIG. 4 depicts a schematic diagram of a remote hydraulic skid consistent with at least one embodiment of the present disclosure.

In some embodiments, with reference to FIGS. 2-4, remote hydraulic skid 131 may include relief valve 109, which may be used to avoid overpressurization of accumulator bottles 108. In some embodiments, remote hydraulic skid 131 may include filter 111 positioned to filter hydraulic fluid 104 as it passes through remote hydraulic skid 131.

In some embodiments, remote hydraulic skid 131 may include hydraulic manifold 133. Hydraulic manifold 133 may receive hydraulic fluid from accumulator bottles 108. Hydraulic manifold 133 may be operatively coupled to control valves 135*a-d*. In some embodiments, for example and without limitation, control valves 135*a-d* may be pneumatically, hydraulically, or electromechanically actuated via hydraulic control valves such as a directional control shuttle valve. Each of the control valves 135*a-d* may be operatively coupled to an opening and closing port of a valve of frac tree 20 (or frac manifold 21 as discussed above), shown in FIGS. 3, 4, such as master valve 22, wing valves 24, and swab valve 26, via a respective hydraulic line 137*a-h*. In some embodiments, when one or more of control valves 135*a-d* are opened, high-pressure hydraulic fluid from hydraulic manifold 133 may flow through the respective hydraulic line 137*a*-h and into the corresponding valve of frac tree 20, thereby causing the respective valve of frac tree 20 or frac manifold 21 to open or close.

Because umbilical 191 carries only electric power, the complexity associated with rigging up remote hydraulic system 100 and any adverse effects caused by running individual hydraulic lines to control valves 135*a-d* may be reduced. Additionally, because remote hydraulic skid 131 includes hydraulic pumps 105, hydraulic fluid reservoir 103, hydraulic manifold 133, and control valves 135*a-d*, without being bound to theory, the pressure drop between hydraulic manifold 133 or accumulator bottles 108 and frac tree 20 may be reduced from the amount of pressure drop associated with multiple hydraulic lines that extend outside of hazardous zone 30, which may allow for a reduction in the amount of hydraulic hose that needs to be installed and retrieved, increase the responsiveness of valves of frac tree 20 and reduce pressure demand on accumulator bottles 108.

In some embodiments, each control valve 135*a-d* may be controlled by control skid 161. Control skid 161 may include interface 163 to allow an operator to control the operation of control valves 135*a-d*. In some embodiments, interface 163 may include one or more manual controls. In other embodiments, interface 163 may include one or more digital controls including, for example and without limitation, a touch-screen interface as discussed further herein below. In some embodiments, control skid 161 may electrically, pneumatically, or hydraulically control the actuation of control valves 135*a-d* via one or more corresponding control lines 165*a-d*. In some embodiments, for example and without limitation, control skid 161 may electrically actuate control valves 135*a-d*, which may be pneumatically or hydraulically actuated. In some embodiments, control skid 161 may control the operation of pump 105.

Although four control valves 135*a-d* are depicted in FIG. 3, remote hydraulic skid 131 may include any number of control valves within the scope of the present disclosure. Additionally, although FIG. 3 depicts only a single frac tree 20, remote hydraulic skid 131 may be configured to control the valves of multiple frac trees 20 within the scope of the present disclosure.

In some embodiments, as shown in FIG. 5-8, remote hydraulic system 200 may be positioned at wellsite 10. In such an embodiment, remote hydraulic skid 231 may be positioned near frac tree 20. In some embodiments, accumulator skid 201, transfer pump skid 253, and control skid 261 may be positioned a distance away from remote hydraulic skid 231 to, for example and without limitation, allow an operator of control skid 261 to remain a safe distance away from frac tree 20 while a wellbore operation is underway. Thus, the operator may be able to operate remote hydraulic system 200 and thereby control the operations of valves of frac tree 20 during such a wellbore operation. For example and without limitation, in some embodiments, control skid 261 may be positioned outside of the defined hazardous zone 30.

Figure 6:
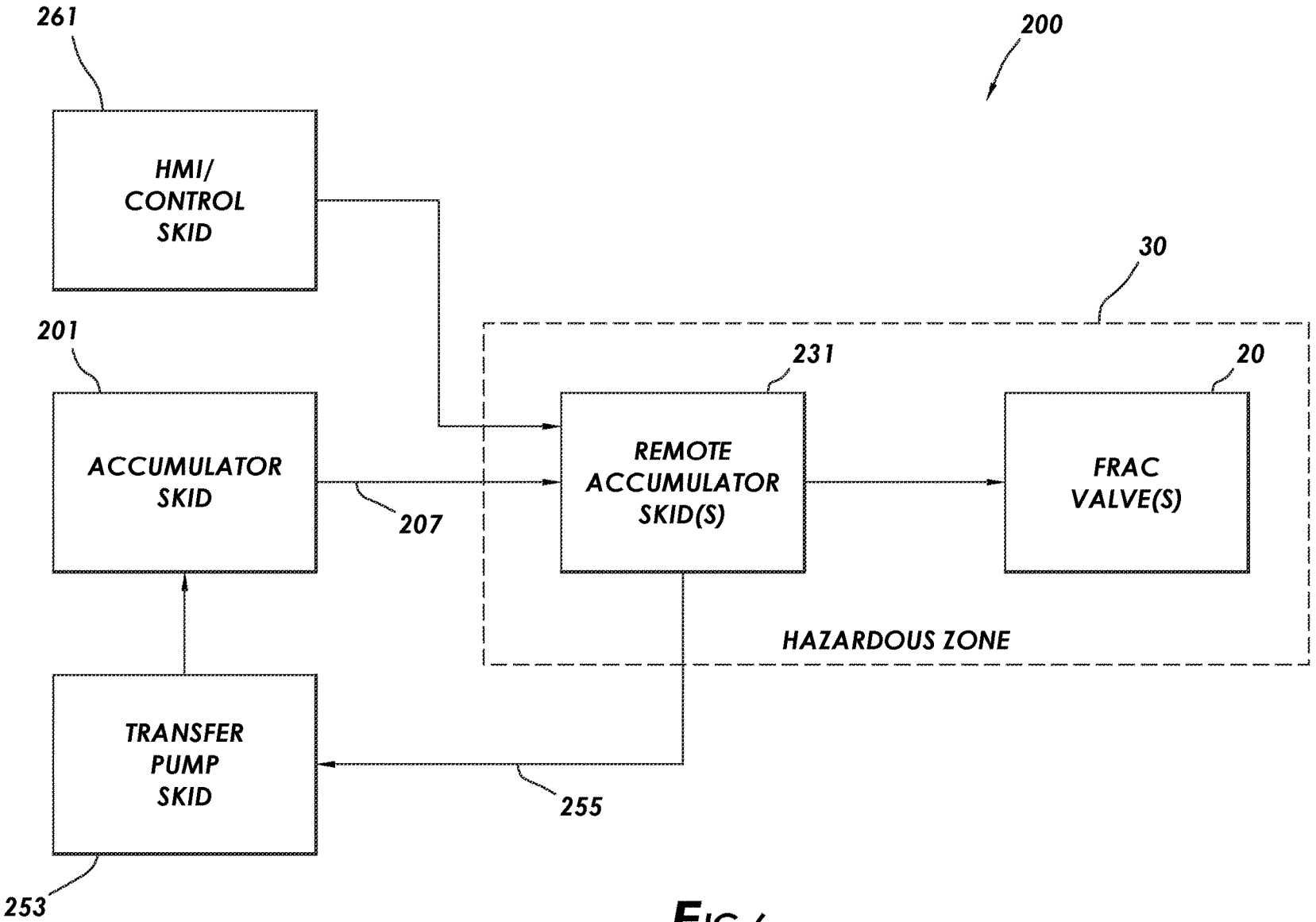
FIG. 6 depicts a schematic diagram of a remote hydraulic system consistent with at least one embodiment of the present disclosure.
Figure 7:
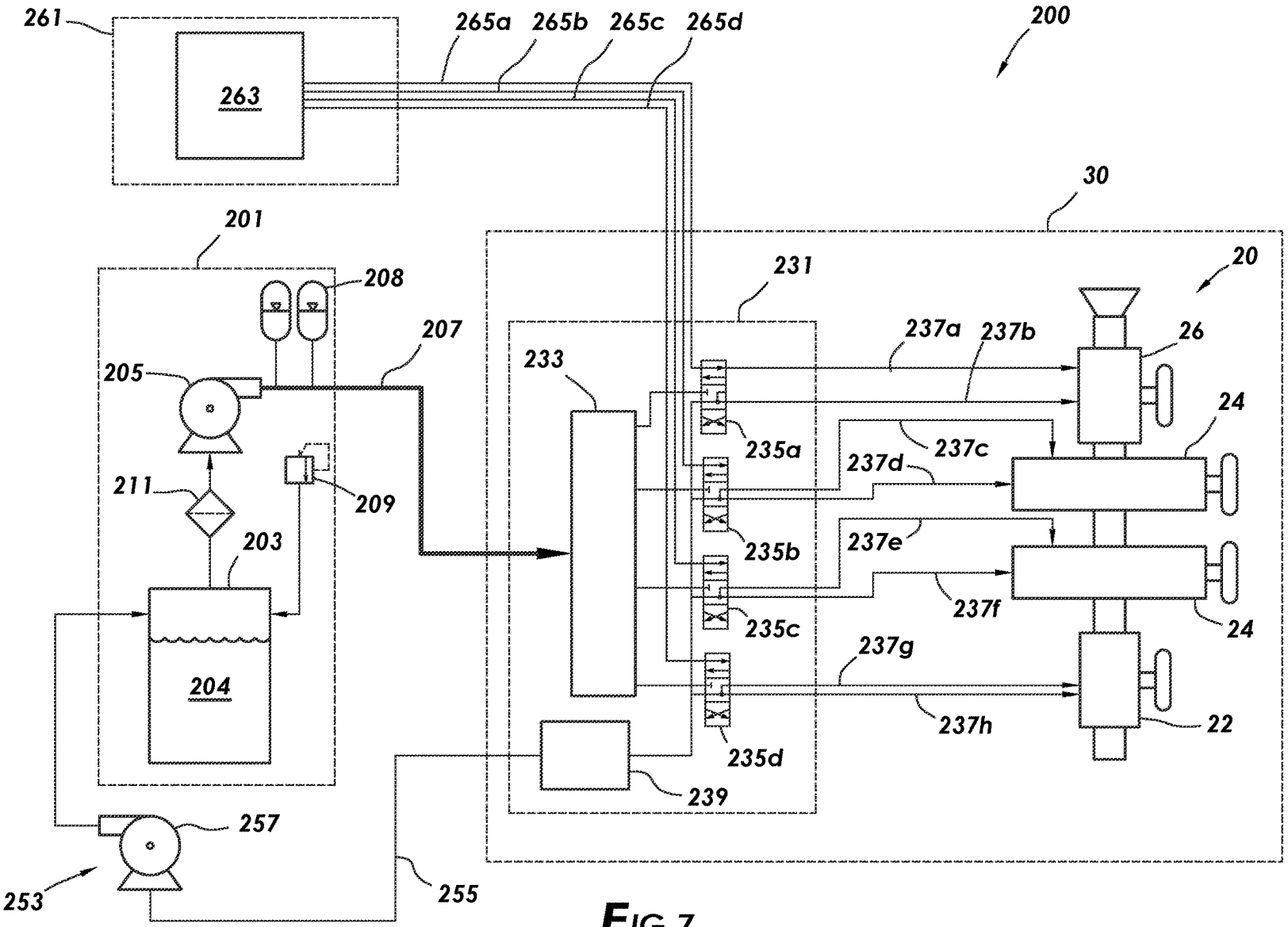
FIG. 7 depicts a process flow diagram of a remote hydraulic system consistent with at least one embodiment of the present disclosure.
Figure 8:
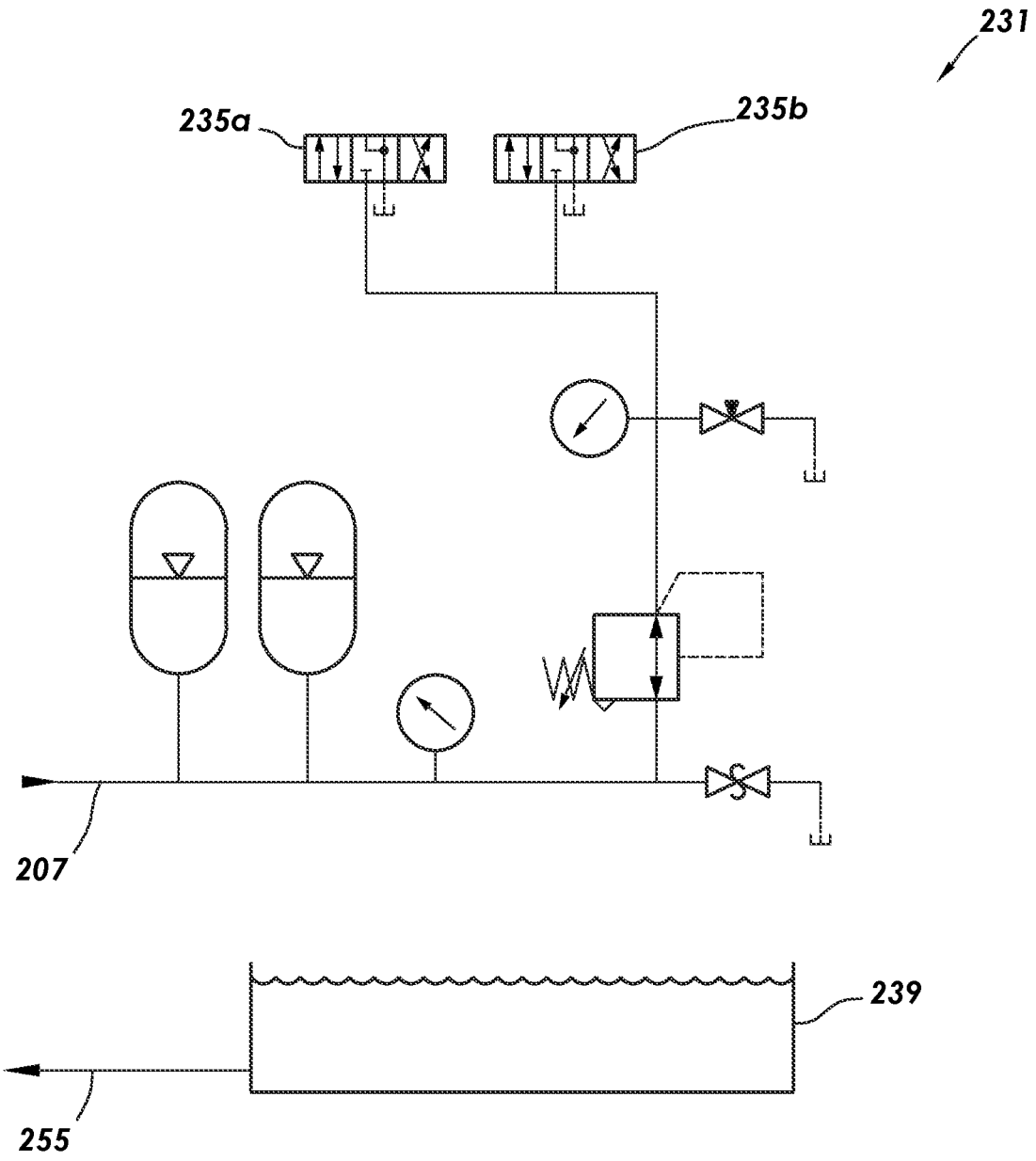
FIG. 8 depicts a schematic diagram of a remote hydraulic skid consistent with at least one embodiment of the present disclosure.

In some embodiments, as depicted in FIGS. 6 and 7, accumulator skid 201, remote hydraulic skid 231, transfer pump skid 253, and control skid 261 may be operatively coupled to allow control of valves of frac tree 20 and frac manifold 21. Although a single accumulator skid 201 and a single remote hydraulic skid 231 are depicted, any number of accumulator skids 201, remote hydraulic skids 231, and transfer pump skids 253 may be used and controlled by a single control skid 261 without deviating from the scope of the present disclosure.

In some embodiments, accumulator skid 201 may include hydraulic fluid reservoir 203. Hydraulic fluid reservoir 203 may be a tank used to store low or no pressure hydraulic fluid 204 for use in remote hydraulic system 200. Accumulator skid 201 may include one or more pumps 205 positioned to charge accumulator bottles 208 of accumulator skid 201. In some embodiments, pumps 205 may be, for example and without limitation, positive displacement pumps such as piston pump, screw pump, or progressing cavity pump. Pumps 205 may output hydraulic fluid into supply umbilical 207 for supply to remote hydraulic skid 231 as further discussed below.

In some embodiments, accumulator skid 201 may be positioned near to remote hydraulic skid 231 within wellsite 10 such that the length of supply umbilical 207 may be reduced. By reducing the length of supply umbilical 207, without being bound to theory, the pressure drop along supply umbilical 207 may be reduced from the amount of pressure drop associated with a supply umbilical that extends outside of hazardous zone 30.

Figure 5:
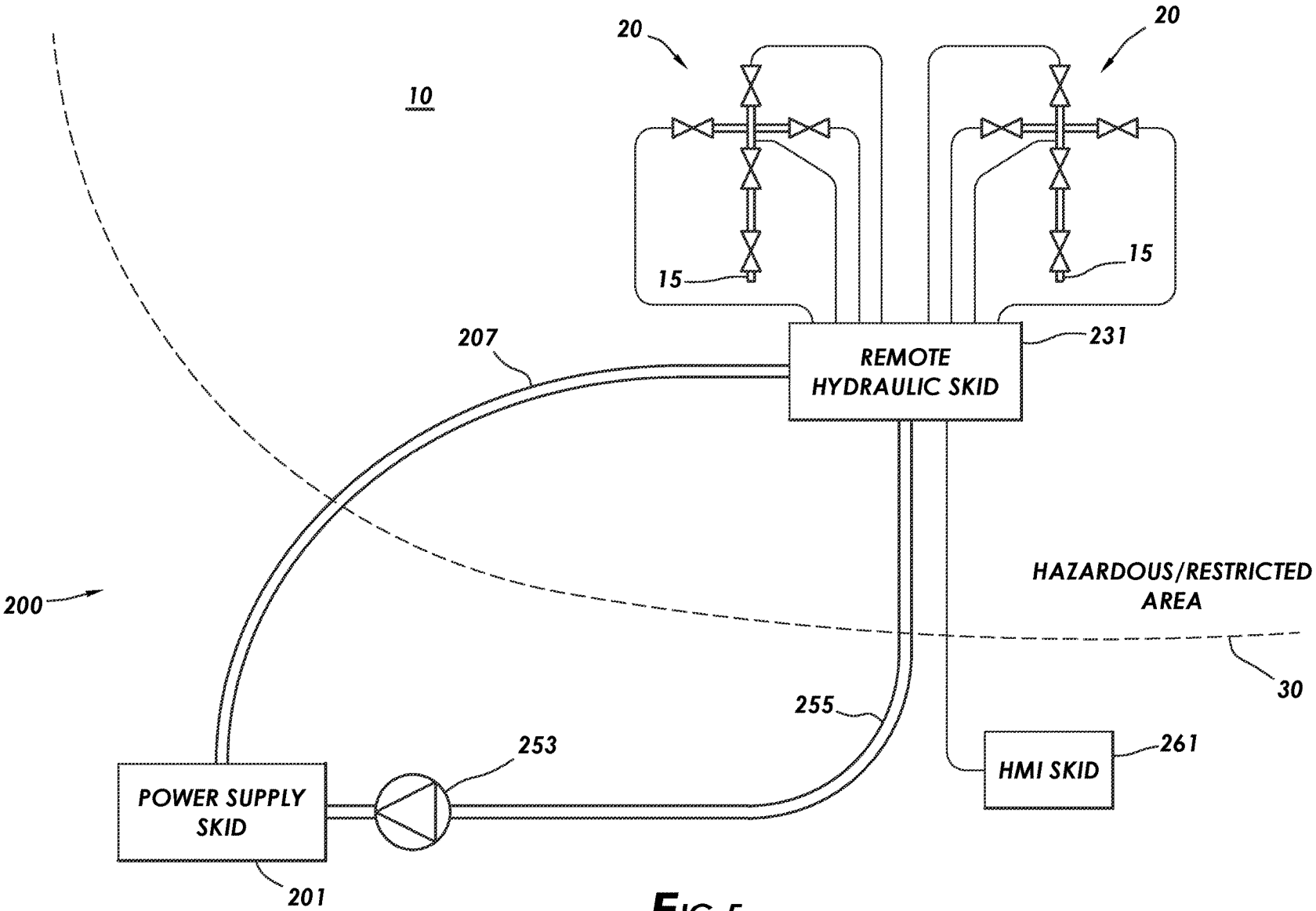
FIG. 5 depicts an overview of a wellsite including a remote hydraulic system consistent with at least one embodiment of the present disclosure.

In other embodiments, such as shown in FIG. 5, accumulator skid 201 may be positioned outside of hazardous zone 30. By using a single, larger supply umbilical 207 as opposed to a plurality of smaller hydraulic lines directly connecting between an accumulator skid positioned outside hazardous zone 30 and frac tree 20, the total pressure drop for each line, the complexity of the system, the time required to rig up or down the system, and the weight of the system may be reduced.

Additionally, by locating remote hydraulic skid 231 at a location nearer to frac tree 20, the response time of the valve may be reduced as compared to a system where remote hydraulic skid 231 is positioned outside of hazardous zone 30 as there is a shorter distance for the hydraulic fluid to travel and there is less fluid resistance in the hose.

In some embodiments, with reference to FIGS. 6 and 7, accumulator skid 201 may include relief valve 209, which may be used to avoid overpressurization of accumulator bottles 208. In some embodiments, accumulator skid 201 may include filter 211 positioned to filter hydraulic fluid 204 as it passes through accumulator skid 201.

In some embodiments, remote hydraulic skid 231 may include hydraulic manifold 233. Hydraulic manifold 233 may receive hydraulic fluid from supply umbilical 207. Hydraulic manifold 233 may be operatively coupled to control valves 235*a-d*. In some embodiments, for example and without limitation, control valves 235*a-d* may be pneumatically, hydraulically, or electromechanically actuated hydraulic control valves such as a directional control shuttle valve. Each of the control valves 235*a-d* may be operatively coupled to an opening and closing port of a valve of frac tree 20 (or frac manifold 21 as discussed above), shown in FIG. 7 as master valve 22, wing valves 24, and swab valve 26, via a respective hydraulic line 237*a-h*. In some embodiments, when one or more of control valves 235*a-d* are opened, high-pressure hydraulic fluid from hydraulic manifold 233 may be allowed to flow through the respective hydraulic line 237*a-h* and into the corresponding valve of frac tree 20, thereby causing the respective valve to open or close.

In some embodiments, remote hydraulic skid 231 may include return reservoir 239. Return reservoir 239 may, in some embodiments, receive hydraulic fluid that returns from a valve of frac tree 20 when the valve is opened or closed. In some embodiments, return reservoir 239 may be fluidly coupled to transfer pump skid 253 via return umbilical 255. Transfer pump skid 253 may include transfer pump 257, positioned to pump hydraulic fluid from return reservoir 239 to hydraulic fluid reservoir 203.

In some embodiments, each control valve 235*a-d* may be controlled by control skid 261. Control skid 261 may include interface 263 to allow an operator to control the operation of control valves 235*a-d*. In some embodiments, interface 263 may include one or more manual controls including, for example and without limitation, buttons, dials, or other components. In other embodiments, interface 263 may include one or more digital controls including, for example and without limitation, a touchscreen interface as discussed further herein below. In some embodiments, control skid 261 may electrically, pneumatically, or hydraulically control the actuation of control valves 235*a-d* via one or more corresponding control lines 265*a-d*. In some embodiments, for example and without limitation, control skid 261 may electrically actuate control valves 235*a-d*, which may be pneumatically or hydraulically actuated. In some embodiments, control skid 261 may control the operation of pump 205 and transfer pump 257.

Although four control valves 235*a-d* are depicted in FIG. 7, remote hydraulic skid 231 may include any number of hydraulic control valves within the scope of the present disclosure. Additionally, although FIG. 7 depicts only a single frac tree 20, remote hydraulic skid 231 may be configured to control the valves of multiple frac trees within the scope of the present disclosure.

In some embodiments, remote hydraulic system 200 may include accumulator skid 201, remote hydraulic skid 231, transfer pump skid 253, and control skid 261. With reference to FIGS. 5-8, in order to operate remote hydraulic system 200 at wellsite 10, accumulator skid 201, remote hydraulic skid 231, transfer pump skid 253, and control skid 261 may be transported to wellsite 10. Remote hydraulic skid 231 may be positioned relatively close to wellhead 15 with which remote hydraulic system 200 will be utilized, while accumulator skid 201, transfer pump skid 253, and control skid 261 may be positioned a distance away from wellhead 15 outside of hazardous zone 30. Supply umbilical 207 and return umbilical 255 may be operatively coupled to remote hydraulic skid 231 from accumulator skid 201 and transfer pump skid 253, respectively. Hydraulic lines 237*a-h* may be operatively coupled between control valves 235*a-d* and opening ports 31 and closing ports 32 of valves of frac tree 20. Control lines 265*a-d* may be operatively coupled between control skid 261 and remote hydraulic skid 231. Pump 205 may be activated to charge accumulator bottles 208 such that hydraulic fluid may be supplied to remote hydraulic skid 231. As desired, one or more of control valves 235*a-d* may be opened to supply hydraulic fluid to the valves of frac tree 20 in order to open or close valves of frac tree 20 using control skid 261.

Figure 9:
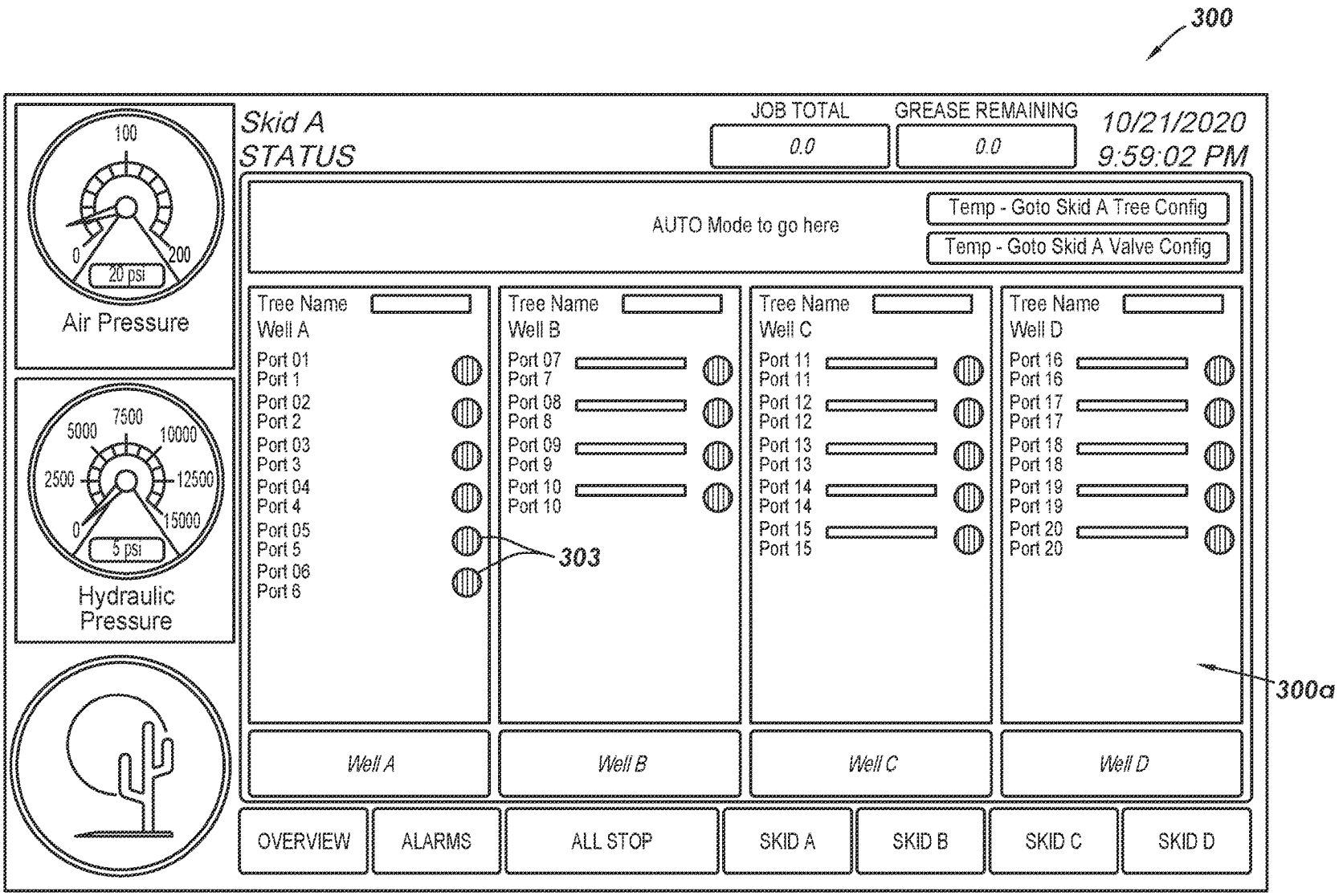
FIG. 9 depicts aspects of a graphical user interface for a control skid consistent with at least one embodiment of the present disclosure.

FIG. 9 depicts an example of graphical user interface 300 for control skid 161/261 consistent with at least one embodiment of the present disclosure. In some embodiments, graphical user interface 300 may be adapted for use in a digital, touchscreen-based embodiment of interface 163. GUI 300 may include one or more controls adapted to allow an operator to control the operation of remote hydraulic system 100/200. In some embodiments, GUI 300 may provide one or more screens for user interaction with remote hydraulic system 100/200. For example and without limitation, in some embodiments, GUI 300 may include status overview display 300*a* as shown in FIG. 9, wherein visual indicators 303 display the status of valve of frac tree 20. In some embodiments, GUI 300 may be used to control multiple frac trees 20. In some embodiments, elements of GUI 300 as discussed herein may be color-coded to allow for association with particular frac trees 20 or otherwise assist with visual identification thereof.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A remote hydraulic system for controlling a valve of a wellhead or frac manifold comprising:

a remote hydraulic skid, the remote hydraulic skid including:

a hydraulic reservoir, a hydraulic pump, and an accumulator;

a hydraulic manifold, the hydraulic manifold operatively coupled to the accumulator; and a hydraulic valve, the hydraulic valve operatively coupled to the hydraulic manifold, the hydraulic valve operatively coupled to the valve of the wellhead or frac manifold by a hydraulic line;

a control skid, the control skid including an interface, the control skid operatively coupled to the remote hydraulic skid by a control line; and a power supply skid, the power supply skid coupled to the remote hydraulic skid to provide the power necessary to drive the hydraulic pump on the remote hydraulic skid;

wherein the remote hydraulic skid is positioned within a threshold distance of the wellhead defining a hazardous zone, and wherein the control skid and power supply skid are positioned outside of the hazardous zone.

2. The remote hydraulic system of claim 1, wherein the power supply skid provides electricity to drive the hydraulic pump on the remote hydraulic skid.

3. The remote hydraulic system of claim 1, wherein the power supply skid provides pneumatic pressure to drive the hydraulic pump on the remote hydraulic skid.

4. The remote hydraulic system of claim 1, wherein the power supply skid comprises a generator.

5. The remote hydraulic system of claim 4, wherein the generator is driven by a diesel engine.

6. The remote hydraulic system of claim 1, wherein the power supply skid comprises an energy storage device.

7. The remote hydraulic system of claim 1, wherein the threshold distance extends between 25 and 150 feet from a frac tree.

8. The remote hydraulic system of claim 1, wherein the hazardous zone is identified as a Class I or Class II location as defined by the National Electrical Code (NEC).

9. A method comprising:

providing a power supply skid;

positioning the power supply skid outside of a threshold distance of a wellhead or a frac manifold defining a hazardous zone;

providing a remote hydraulic skid, the remote hydraulic skid including:

a hydraulic reservoir, a hydraulic pump, accumulator, and a hydraulic manifold; and a hydraulic valve, the hydraulic valve operatively coupled to the hydraulic manifold, the hydraulic valve having an output port;

positioning the remote hydraulic skid within the hazardous zone;

operatively coupling the hydraulic pump to the power supply skid by a supply umbilical;

coupling the output port of the hydraulic valve to a port of a valve of the wellhead or the frac manifold by a hydraulic line;

providing a control skid, the control skid including an interface;

positioning the control skid outside of the hazardous zone;

operatively coupling the control skid to the remote hydraulic skid by a control line; the control skid adapted to control the actuation of the hydraulic valve;

providing power to the remote hydraulic skid with the power supply skid;

actuating the hydraulic valve with the control skid; and providing hydraulic fluid to the valve of the wellhead or the frac manifold.

10. The method of claim 9 further comprising supplying electricity to the hydraulic pump from the power supply skid.

11. The method of claim 9 further comprising supplying pneumatic pressure from the power supply skid to drive the hydraulic pump on the remote hydraulic skid.

12. The method of claim 9, wherein the power supply skid comprises a generator.

13. The method of claim 12 further comprising driving the generator with a diesel engine.

14. The method of claim 10, wherein the power supply skid comprises an energy storage device.

15. The method of claim 9, wherein the threshold distance extends between 25 and 150 feet from frac tree.

16. The method of claim 9, wherein the hazardous zone is identified as a Class I or Class II location as defined by the NEC.

17. The method of claim 9, wherein the power supply skid comprises solar panels.

18. The method of claim 9 further comprising charging the energy storage device with a generator or solar panels.

* * * * *